US009567806B2

(12) United States Patent
van der Waal

(10) Patent No.: US 9,567,806 B2
(45) Date of Patent: Feb. 14, 2017

(54) DRILLING BUCKET AND METHOD FOR DRILLING A BORE HOLE

(71) Applicant: BAUER SPEZIALTIEFBAU GMBH, Schrobenhausen (DE)

(72) Inventor: Karl van der Waal, Selangor Darul Ehsan (MY)

(73) Assignee: BAUER SPEZIALTIEFBAU GmbH, Schrobenhausen (DE)

( * ) Notice: Subject to any disclaimer, the term of this patent is extended or adjusted under 35 U.S.C. 154(b) by 691 days.

(21) Appl. No.: 13/948,899

(22) Filed: Jul. 23, 2013

(65) Prior Publication Data

US 2014/0034385 A1 Feb. 6, 2014

(30) Foreign Application Priority Data

Aug. 6, 2012 (EP) ..... 12005717

(51) Int. Cl.

| | |
|---|---|
| ***E21B 7/00*** | (2006.01) |
| ***E21B 27/00*** | (2006.01) |
| ***E21B 7/26*** | (2006.01) |
| ***E21B 17/10*** | (2006.01) |

(52) U.S. Cl.

CPC ..... *E21B 7/003* (2013.01); *E21B 7/265* (2013.01); *E21B 17/10* (2013.01); *E21B 27/00* (2013.01)

(58) Field of Classification Search

CPC ..... E21B 7/00; E21B 7/006

See application file for complete search history.

(56) References Cited

U.S. PATENT DOCUMENTS

| | | | | |
|---|---|---|---|---|
| 2,122,584 A | | 7/1938 | Peck | |
| 2,873,950 A | * | 2/1959 | Kandle | E21B 4/18 173/141 |
| 2,915,288 A | * | 12/1959 | Crapez | E02D 7/28 173/109 |
| 3,376,942 A | * | 4/1968 | Van Winkle | E21B 4/04 175/215 |
| 4,228,862 A | * | 10/1980 | Causse | E21B 7/002 175/242 |
| 4,335,793 A | * | 6/1982 | Roblin | E21B 7/00 175/249 |

(Continued)

FOREIGN PATENT DOCUMENTS

| | | |
|---|---|---|
| CN | 2256464 Y | 6/1997 |
| DE | 1029757 C1 | 7/2003 |

(Continued)

OTHER PUBLICATIONS

The extended European search report issued on Jan. 4, 2013, which corresponds to EP12005717.9 and is related to U.S. Appl. No. 13/948,899.

*Primary Examiner* — Elizabeth Gitlin

(74) *Attorney, Agent, or Firm* — Studebaker & Brackett PC

(57) ABSTRACT

A drilling bucket for drilling a bore hole in the ground including a hollow cylindrical body and at least one cutting tool arranged at a lower side of the hollow cylindrical body for cutting soil material. The hollow cylindrical body has a lower opening for receiving soil material cut by the at least one cutting tool. For guiding the hollow cylindrical body in the bore hole an upper guiding device is provided which is arranged above the hollow cylindrical body and fixed to the hollow cylindrical body. The upper guiding device is configured to abut on a side wall of the bore hole.

18 Claims, 2 Drawing Sheets

(56) References Cited

U.S. PATENT DOCUMENTS

| | | | | |
|---|---|---|---|---|
| 4,732,226 | A * | 3/1988 | Ebeling | E21B 4/16 175/102 |
| 5,431,238 | A | 7/1995 | Trevisani | |
| 6,892,834 | B1 * | 5/2005 | Beck, III | E21B 4/20 175/108 |
| 2006/0060386 | A1 | 3/2006 | Reich | |

FOREIGN PATENT DOCUMENTS

| | | | |
|---|---|---|---|
| EP | 1640507 | A1 | 3/2006 |
| JP | 726867 | A | 1/1995 |
| JP | 11294059 | A | 10/1999 |
| JP | 2001032668 | A | 2/2001 |
| JP | 2004060186 | A | 2/2004 |
| JP | 2009-155961 | A | 7/2009 |

* cited by examiner

DRILLING BUCKET AND METHOD FOR DRILLING A BORE HOLE

The invention relates to a drilling bucket for drilling a bore hole in the ground according to the preamble of claim 1 and a method for drilling a bore hole in the ground according to the preamble of claim 17.

The drilling bucket comprises a hollow cylindrical body and at least one cutting tool arranged at a lower side of the hollow cylindrical body for cutting soil material. The hollow cylindrical body has a lower opening for receiving soil material cut by the at least one cutting tool.

In the method for drilling a bore hole in the ground a drilling bucket comprising a hollow cylindrical body and at least one cutting tool arranged at a lower side of the hollow cylindrical body is rotated and the hollow cylindrical body is filled with soil material cut by the at least one cutting tool.

The use of drilling buckets to excavate the ground so as to form a bore hole is well known. Soil material, for example earth and sand, is excavated by the cutting tool of the drilling bucket and received in the hollow cylindrical body for evacuation above the ground. The method for drilling a bore hole in the ground with a drilling bucket is a discontinuous method. The hollow cylindrical body is filled with soil material, lifted above the ground, evacuated and then again placed in the bore hole for further excavation of soil material. The drilling bucket is conventionally connected to a drill rod, in particular a Kelly-bar, for applying a torque to the drilling bucket so as to rotate the drilling bucket.

A conventional drilling bucket is for example described in EP 1 640 507 A1. The drilling bucket has a cylindrical body whose diameter corresponds to the diameter of the bore hole to be excavated. The cylindrical body abuts on the side wall of the bore hole and is thereby properly guided within the bore hole during the creation of the bore hole.

For drilling the bore hole in the ground, a supporting structure such as a supporting vehicle is placed on the ground surface and supports the drill rod with the drilling bucket connected to it. The supporting structure conventionally has a mast and a drill drive which is axially slidable along the mast for applying a rotating force and an axial force to the drill rod. After finalizing the drilling process, the drill string comprising the drill rod and the drilling bucket is lifted from the bore hole by means of the supporting structure. A supporting vehicle having a lower carriage, an upper carriage, a mast and a drill drive movable along the mast is shown for example in DE 102 19757 C1.

In recent times a need has arisen to construct bore holes with very large diameters, for example diameters being as large as three meters or more. If in this case the size of the drilling bucket would simply be increased, the drilling bucket would become too heavy to be handled by a conventional supporting system. On the other hand, if the axial height of the drilling bucket is reduced, the drilling bucket would not be properly guided within the bore hole, bearing the risk of tilting of the drilling bucket so that the drilling bucket could get stuck in the bore hole.

JP 2009-155961 A discloses a drilling bucket for an earth-drilling machine having a stabilizer attached to the upper part of the drilling bucket through a plurality of mounting legs. The stabilizer has an equal external diameter as that of the drilling bucket.

It is therefore an object of the invention to provide a drilling bucket and a method for drilling a bore hole in the ground being particularly suitable for drilling bore holes in the ground having large diameters.

The object is solved according to the invention with a drilling bucket according to claim 1 and a method for drilling a bore hole in the ground according to claim 17. Preferred embodiments are given in the dependent claims.

According to the invention, for guiding the hollow cylindrical body in the bore hole an upper guiding device is provided which is arranged above the hollow cylindrical body and fixed to the hollow cylindrical body, wherein the upper guiding device is configured to abut on a side wall of the bore hole.

Regarding the method for drilling a bore hole in the ground, an upper guiding device, which is arranged above the hollow cylindrical body, abuts on a side wall of the bore hole and guides the hollow cylindrical body within the bore hole during drilling of the bore hole.

The inventive guiding device provides a guiding surface above the hollow cylindrical body which allows the axial height of the cylindrical body to be reduced without taking a risk of tilting the drilling bucket within the bore hole. Even if the height of the hollow cylindrical body is significantly reduced, the loss of axial height can be compensated with the provision of the guiding device being arranged above the hollow cylindrical body. Therefore, the guiding device increases the axial height of the drilling bucket such that a proper guidance of the drilling bucket in the bore hole is assured.

One basic idea of the invention is therefore to provide a structure which allows for reducing the axial height of the hollow cylindrical body in order to reduce the total weight of a drilling bucket and at the same time assure a proper guiding of the drilling bucket in the drill hole. This is achieved according to the invention by providing a guiding structure above the hollow cylindrical body which extends the axial height of the drilling bucket to a degree that reliably prevents the drilling bucket from tilting in the bore hole.

The guiding device according to the invention is a separate structure provided in addition to the hollow cylindrical body. It is attached and fixed to the hollow cylindrical body, for example by means of welding, screw and/or bolt connections. The guiding device has a guiding surface facing towards the bore hole for abutment against the bore hole. The guiding faces are in particular static elements, i.e. elements which are not movable and which have a defined orientation with respect to the hollow cylindrical body. For guiding the hollow cylindrical body in the bore hole the abutment faces are arranged such that they abut against the wall of the bore hole cut by the cutting tools of the drilling bucket.

According to the invention it is preferred that the guiding device includes a guide ring for abutment on the side wall of the bore hole. A guide ring has a ring-shaped abutment surface which provides a uniform support against the bore hole wall. Moreover the guide ring provides a free central space which can be passed by a fluid during sinking and lifting of the drilling bucket, for example a stabilizing fluid for stabilizing the bore hole or a setting fluid for forming a pile in the ground. The guide ring is preferably axially displaced from the cylindrical body so as to increase the axial height of the drilling bucket to a predetermined value.

In addition or in place of the guide ring, the guiding device may include a plurality of individual guide elements, which are for example arranged along a circular path around a central axis of the drilling bucket, for abutment on the side wall of the bore hole.

The guiding device is preferably supported by means of at least one support plate extending substantially perpendicular to a cross-section of the bore hole. The support plate fixes the guiding device to the hollow cylindrical body. The vertical orientation of the support plate allows for a good flow of fluid through the guiding device in an axial direction of the drilling bucket.

In another preferred embodiment a coupling device is arranged centrally with regard to a cross-section of the bore hole for connecting a drill rod, in particular a Kelly-bar. The coupling device, in particular a so-called Kelly-box for receiving a connecting element of a Kelly-bar, is preferably arranged at the hollow cylindrical body below the guiding device for transferring a torque of the drill rod directly to the hollow cylindrical body. The guiding device is preferably configured to surround the drill rod connected to the hollow cylindrical body without receiving a torque from it. Therefore the guiding device can be constructed in a light manner, because it does not transfer a torque from the drill rod to the cylindrical body.

The guiding device is preferably free of cutting elements and only serves for stabilizing the drilling bucket in the bore hole. It rotates together with the drilling bucket and to this end, a rotating movement is transferred from the hollow cylindrical body to the guiding device, preferably via the supporting plates which support the guiding device on the hollow cylindrical body. As no cutting is performed by the guiding device, the forces acting on the guiding device are relatively weak and the guiding device can have a light construction.

According to the invention it is preferred that the upper guiding device has an arcuate outer surface for contacting the side wall of the bore hole. The arcuate surface preferably extends along an axial direction of the drilling bucket for a proper sliding of the guiding device along the side wall of the bore hole during lowering and lifting of the drilling bucket. The contacting surface of the guiding device can in particular have a tapered upper and lower portion and a cylindrical portion between the tapered ends.

The hollow cylindrical body for containing cut soil material has a diameter and an axial height. Preferably, the diameter is greater than the axial height. This allows the construction of very large bore holes without exceeding a given maximum weight of the drilling bucket.

According to the invention it is preferred that a ratio of a diameter of the hollow cylindrical body to an axial height of the hollow cylindrical body is at least 1:1, and in particular ranges between 1:1 and 5:1. It could be established, that these proportions provide a good stability of the drilling bucket and allow an easy discharging of the bucket even if loaded with cohesive and sticky soil.

In another preferred embodiment the hollow cylindrical body is a conical shaped body with the bigger diameter at the lower side, i.e. the discharge or gate side of the body. This facilitates discharging the bucket and also would allow for a smaller ratio of the diameter of the hollow cylindrical body to its axial height like for example 1:1.5 or 1:2.

According to the invention it is preferred that the upper guiding device is axially displaced from the hollow cylindrical body. In particular, the contacting surface of the guiding device for contacting the bore hole is displaced from a lower contacting surface provided radially around the hollow cylindrical body. Therefore, preferably, at least two separate guiding or contacting surfaces are provided, namely one around the hollow cylindrical body and another one above the hollow cylindrical body. The separate contacting surfaces are axially displaced from one another, so the axial height of the contacting surfaces is lower than the axial height of the drilling bucket. This reduces the weight of the drilling bucket and the friction at the bore hole wall.

According to the invention it is preferred that the upper guiding device is detachably connected to the hollow cylindrical body. In other words, the upper guiding device is a separate element from the hollow cylindrical body which can be disconnected from the hollow cylindrical body. Such a modular design allows for easily replacing the guiding device.

In another preferred embodiment a plurality of cutting elements is disposed at the lower side of the hollow cylindrical body, wherein upon rotation of the drilling bucket soil material is removed along substantially the entire cross-section of the hollow cylindrical body. The cutting elements, in particular individual cutting teeth, are preferably arranged along a radially extending line along an edge of a lower opening of the hollow cylindrical body. Soil material cut by the cutting teeth is conveyed into the hollow cylindrical body. More preferably, the hollow cylindrical body includes a rotary bottom plate for opening and closing the lower opening of the body. The cutting teeth are preferably connected to the rotary bottom plate such that upon rotation of the drilling bucket in a first direction the bottom plate opens and upon rotation in a second direction the bottom plate closes when the cutting teeth contact a bottom surface of the bore hole.

A lower guiding device is arranged around an outer circumference of the hollow cylindrical body for abutment against the side wall of the bore hole. The lower guiding device may have a smaller axial height than the hollow cylindrical body so that the friction to the side wall of the bore hole is reduced. The diameter of the lower guiding device is larger than the diameter of the hollow cylindrical body, so that the hollow cylindrical body generally does not contact the side wall of the bore hole.

Moreover, the lower guiding device allows for a very easy adjustment of the diameter of the drill hole without replacing the hollow cylindrical body. In addition to providing a guiding function the lower guiding device may also have displacing means for displacing soil material into the side-wall of the bore hole. The displacing means can for example be a tapered surface for displacing soil material radially outwardly into the side wall of the bore hole.

It is preferred that the lower guiding device includes a guide ring. A guide ring provides a uniform support against the bore hole wall. It can be constructed substantially in the same manner as the upper guide ring.

In addition or in place of the guide ring, the lower guiding device may include a plurality of individual guide elements, which are for example arranged along a circular path around a central axis of the drilling bucket, for abutment on the side wall of the bore hole.

In order to provide a different drilling diameter with a given hollow cylindrical body, the lower guiding device is preferably disconnectable from the hollow cylindrical body and a lower guiding device having a different diameter can be mounted. This modular design renders it possible to provide one hollow cylindrical body for different diameters of a bore hole to be drilled.

According to the invention it is preferred that the lower guiding device is configured to leave a substantially ring-shaped passageway around the hollow cylindrical body for a fluid bypass around the circumference of the hollow cylindrical body, particular almost the entire circumference of the hollow cylindrical body. Such a ring-shaped bypass area allows for a large flow of fluid in an axial direction around the hollow cylindrical body and therefore increases the obtainable lifting speed of the drilling bucket during extraction and/or after finalization of the bore hole.

It is preferred that the cutting tool extends in a radial direction beyond an outer periphery of the hollow cylindrical body. In other words the cutting diameter of the cutting tool is larger than the diameter of the hollow cylindrical body. This allows for drilling a bore hole having a diameter which is larger than the diameter of the hollow cylindrical body.

Preferably a soil conveying element is arranged below the hollow cylindrical body for conveying soil material radially inwardly into the hollow cylindrical body. Soil material which is cut by the cutting tool along a circular path around the hollow cylindrical body, is conveyed towards the opening of the hollow cylindrical body to be received in the hollow body. The soil conveying element may also include a cutting portion or cutting edge for cutting soil material radially outside the hollow cylindrical body.

Another preferred embodiment has the feature that a soil displacement element is provided for displacing soil material into the side wall of the bore hole. The soil displacement element may be arranged below the hollow cylindrical body, at an outside portion of the hollow cylindrical body or even above the hollow cylindrical body. The displacement element may be a separate element or be an integral part of the lower and/or the upper guiding device. It displaces in particular soil material, which is cut by the cutting tool along a circular path around the hollow cylindrical body, into the wall of the bore hole.

The invention also refers to a drilling machine comprising a mast, a drill rod and a rotary drive for rotationally driving the drill rod, wherein a drilling bucket according to the invention is connected to a lower end of the drill rod. The drill rod may in particular be a Kelly-bar having a connection element at its lower end. The drill rod may comprise a plurality of drill rod elements axially connected to each other.

The inventive drilling bucket has in particular the following advantages:

- weight reduction on the bucket itself compared to a conventional full size bucket;
- the guiding length can be adjusted to suit the requirements (verticality of 1:100/1:200 for example);
- the size of the drilling bucket can be adjusted to fit the available main winch line pull in respect of the ground and volume to be drilled;
- a high ratio of stabilizing fluid bypass cross section over total drilling cross section, for example 1:3; the ratio can be optimized to suit application;
- stabilizing the fluid bypass around the total circumference—instead of forcing it through an off-center positioned channel—results in better insertion and extraction of the bucket through the bore hole;
- the symmetric cutting bottom can be optimized since there is no need to compromise the design to accommodate the bypass channel;
- reduced skin friction torque losses since only two guide rings—and as the case may be body extensions—are in contact with the bore hole; this results in better efficiency;
- the form of the guide rings facilitates lubrication on their outside during lifting and lowering, thus reducing friction;
- wear parts/items can be replaced easily and more cost effective than on conventional bucket;
- one bucket body size could cover several drilling diameters without having to change the whole body.

The invention will be further described with reference to the attached schematic drawings, in which.

In all figures, the same or corresponding elements are denoted with the same reference signs.

Figure 1:
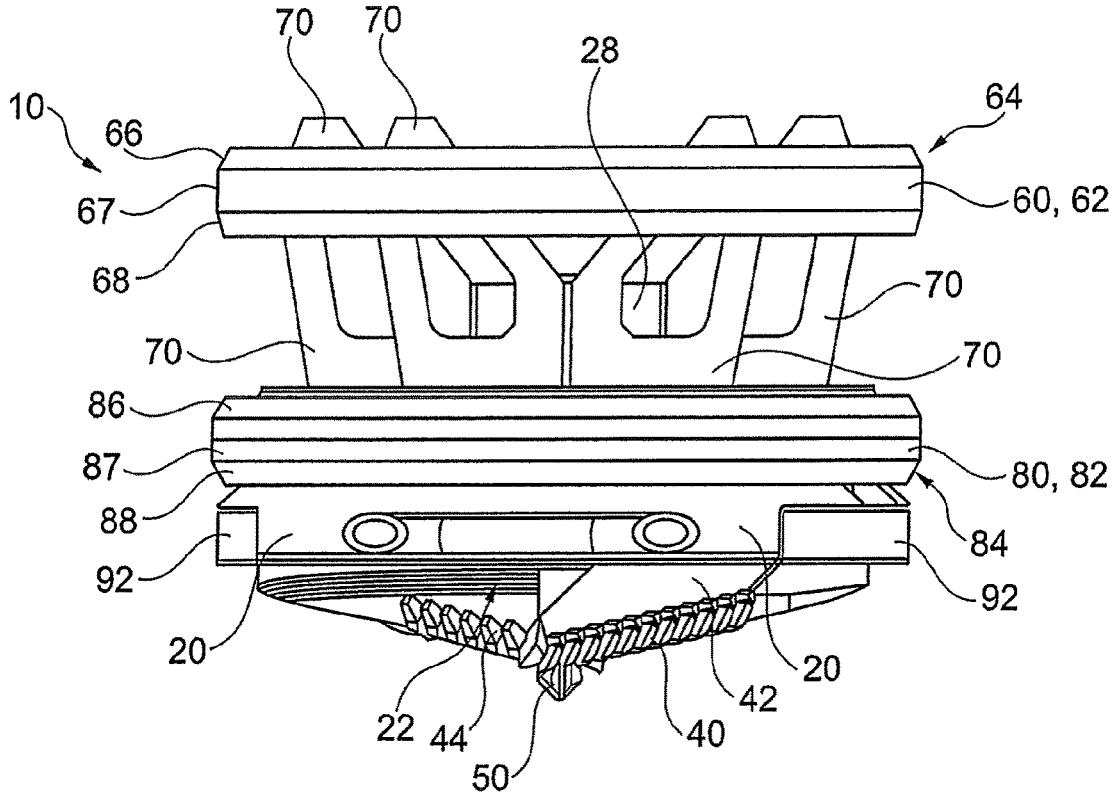
FIG. 1 shows a side view of a drilling bucket according to the invention.
Figure 2:
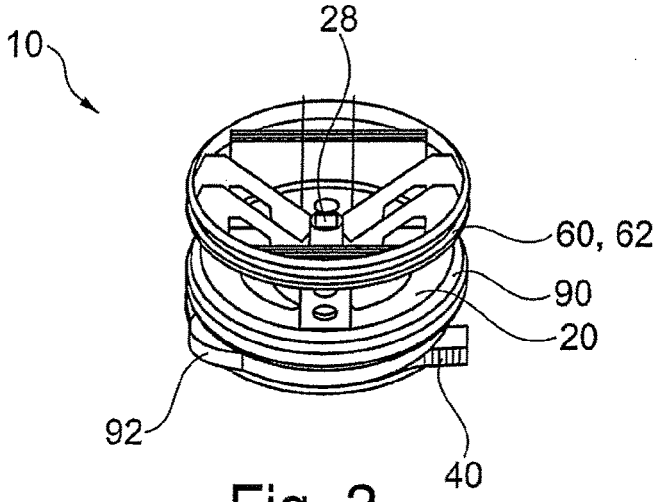
FIG. 2 shows a perspective view of the drilling bucket according to FIG. 1.

FIGS. 1 and 2 show a first embodiment of an inventive drilling bucket 10. The drilling bucket 10 includes a hollow cylindrical body 20 for containing soil material therein. A diameter of the hollow cylindrical body 20 is larger than an axial height of the hollow cylindrical body 20. The drilling bucket 10 is particularly suitable for drilling large-diameter holes having diameters preferably larger than three meters in diameter. The height of the bucket 10 can for example be up to two meters.

For stabilizing the drilling bucket 10 in the bore hole, i.e. to prevent a tilting of the drilling bucket 10 within the bore hole, the drilling bucket 10 has above the hollow cylindrical body 20 an upper guiding device 60 which is configured to contact a side wall of the bore hole. According to the shown embodiment the upper guiding device 60 is configured as a guide ring 62 being arranged in a coaxial manner relative to the cylindrical body 20. The guide ring 62 has an arcuate outer surface 64 for contacting the side wall of the bore hole. The arcuate outer surface 64 has an upper tapered portion 66, a lower tapered portion 68 and a cylindrical portion 67 extending between the upper and lower tapered portions 66, 68. The tapered portions 66, 68 provide a reduced friction to the bore hole and can serve as displacement means for displacing soil material into the wall of the bore hole The guiding device 60 is fixed to the hollow cylindrical body 20 by means of support plates 70 which each extend in a plane that is perpendicular to a cross-section of the bore hole. The support plates 70 are arranged within the guide ring 62 and are connected to the guide ring 62 at an inner surface thereof. The guiding device 60 or guide ring 62 is held remotely from the hollow cylindrical body 20 by means of the support plates 70.

For producing the bore hole, i.e. for cutting soil material at the bottom of the bore hole, the drilling bucket 10 comprises a cutting tool 40 arranged below the hollow cylindrical body 20. The cutting tool 40 comprises a plurality of cutting teeth 44 which are arranged along a line extending substantially along a diameter of the bore hole to be cut. In other words, the cutting teeth 44 are arranged in a radial direction between a center of the bore hole and an outer circumference of the bore hole. For supporting the cutting teeth 44 a cutting teeth support bar 42 is provided.

A centering tool 50 is provided at a lower central point of the drilling bucket 10. The centering tool 50, which can also be referred to as a pilot or pilot tool, protrudes with regard to the cutting teeth 44 in an axial direction of the drilling bucket 10.

A lower guiding device 80 is arranged around the hollow cylindrical body 20 for abutment against the side wall of the bore hole. The lower guiding device 80 keeps the hollow cylindrical body 20 displaced from the wall of the bore hole, so that the hollow cylindrical body 20 does not contact the bore hole. The axial height of the guiding device 80 is lower than the axial height of the hollow cylindrical body 20.

In order to provide an efficient fluid bypass around the circumference of the hollow cylindrical body 20 during lowering and lifting the drilling bucket 10 within the bore hole, the lower guiding device 80 is arranged around the hollow cylindrical body 20, providing a substantially ring-shaped bypass area between the hollow cylindrical body 20 and the lower guiding device 80. The lower guiding device 80 is formed as a guide ring 82 which is attached to the hollow cylindrical body 20 by means of a plurality of support plates 90. The support plates 90 extend substantially transversely to a cross-section of the bore hole in a regular pattern around the circumference of the hollow cylindrical body 20. In the embodiment according to FIGS. 1 and 2, eight support plates 90 are provided.

The lower guide ring 82 is shaped in a corresponding manner as the upper guide ring 62. In particular, the lower guide ring 82 also has an arcuate outer surface 84. The curvature of the outer surface 84 of the guide ring 82 extends in an axial direction of the drilling bucket 10. The arcuate outer surface 84 has an upper tapered portion 86, a lower tapered portion 88 and a cylindrical portion 87 extending between the upper and lower tapered portions 86, 88. The tapered portions 86, 88 provide a reduced friction to the bore hole and can serve as displacement means for displacing soil material into the wall of the bore hole.

The cutting tool 40 comprising the cutting teeth 44 extends in a radial direction beyond the outer circumference of the hollow cylindrical body 20 for cutting soil material below the bypass area and/or below the lower guide ring 82.

According to the invention there are generally two options for the processing of soil being cut radially outside the hollow cylindrical body 20: A first option is to guide the soil material in a radial direction in the hollow cylindrical body. A second option is to displace the soil material radially to the outside into the wall of the bore hole. Both measures can be combined.

The drilling bucket 10 includes a soil displacement element 92 for displacing soil cut by a cutting tooth 44 arranged radially outside the hollow cylindrical body 20 into a side wall of the bore hole. The soil displacement element 92 has an arcuate outer surface whose curvature extends in a circumferential direction of the drilling bucket 10. The soil displacement element 92 is configured to contact the side wall of the bore hole, similar to the upper guiding device 60 and the lower guiding device 80. Therefore, the upper guiding device 60, the lower guiding device 80 and the soil displacement element 92 provide equal diameters of the drilling bucket 10 at their respective contacting faces for contacting the bore hole.

In a central portion of the drilling bucket 10 a connection element or coupling device 28 for connecting a drilling rod is arranged. The coupling device 28 can in particular be a so-called Kelly-box into which a Kelly-bar can be inserted. The coupling device 28 is directly connected to the hollow cylindrical body 20 for transferring a torque applied by the drill rod to the hollow cylindrical body 20. In other words, the torque is not transferred to the hollow cylindrical body via the upper guiding device 60. The coupling device 28 for connecting a drill rod is arranged below the upper guiding device 60.

Figure 3:
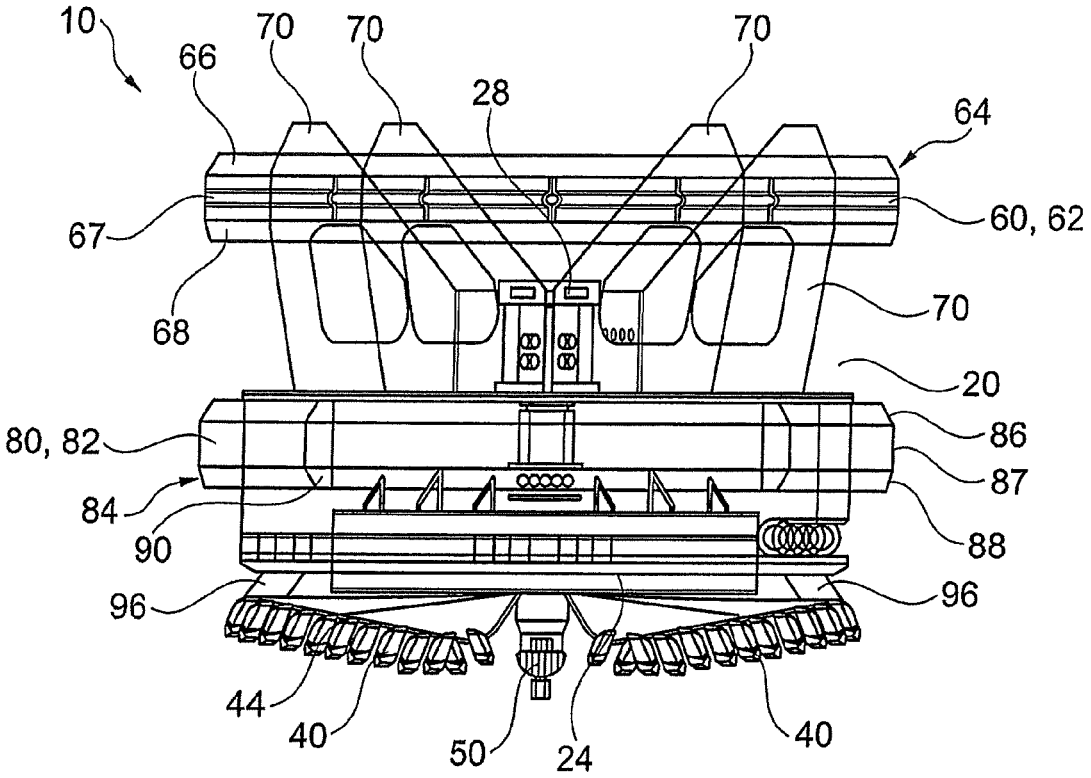
FIG. 3 shows a side view of a drilling bucket according to the invention showing further details of the drilling bucket.
Figure 4:
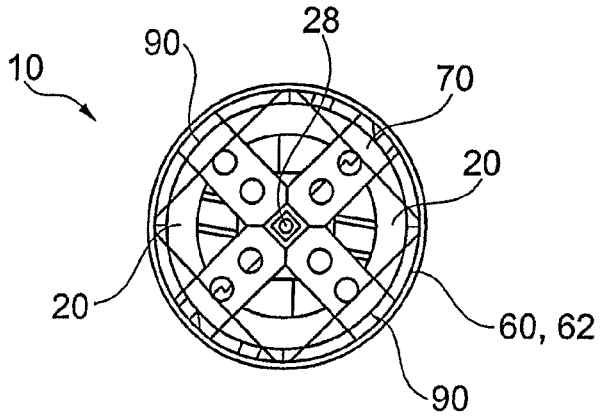
FIG. 4 shows a top view of a drilling bucket according to the invention.

The embodiment shown in FIGS. 3 and 4 differs from the previous embodiment according to the FIGS. 1 and 2 in that the support plates 70 for supporting the upper guide ring 62 are arranged in a star-shaped manner around a central axis of the drilling bucket 10, whereas according to FIGS. 1 and 2 two pairs of support plates 70 are arranged in a parallel manner.

In addition, a soil conveying element 96 is provided for conveying soil material radially inwardly towards the lower opening 22 of the hollow cylindrical body 20. The soil conveying element 96 extends in a radial direction beyond the hollow cylindrical body and is preferably arranged at least in part axially above the outer cutting teeth 44. It has a guide surface for guiding the soil material cut by the outer cutting teeth 44 radially inwardly into the hollow cylindrical body 20.

The invention claimed is:

1. A drilling bucket for discontinuously drilling a bore hole in the ground comprising a hollow cylindrical body, at least one cutting tool arranged at a lower side of the hollow cylindrical body for cutting soil material, the hollow cylindrical body having a lower opening for receiving soil material cut by the at least one cutting tool, and an upper guiding device for guiding the hollow cylindrical body in the bore hole, the upper guiding device being arranged above the hollow cylindrical body and fixed to the hollow cylindrical body and being configured to abut on a side wall of the bore hole, a lower guiding device arranged around an outer circumference of the hollow cylindrical body for abutment against the side wall of the bore hole, and the upper and lower guiding devices each have a diameter which is larger than a diameter of the hollow cylindrical body, wherein the hollow cylindrical body for discontinuously drilling the bore hole in the ground is configured to be filled with soil material, lifted above the ground, evacuated and then again placed in the bore hole for further excavation of soil material, wherein at least one of the upper guiding device and the lower guiding device is ring-shaped, and wherein at least one of the upper guiding device and the lower guiding device comprises a continuous arcuate outer surface having a continuous diameter.

2. The drilling bucket according to claim 1, wherein at least one of the upper guiding device and the lower guiding device includes a guide ring for abutment on the side wall of the bore hole.

3. The drilling bucket according to claim 1, wherein at least one of the upper guiding device and the lower guiding device is supported by at least one support plate extending substantially perpendicular to a cross-section of the bore hole.

4. The drilling bucket according to claim 1, wherein a coupling device is arranged centrally with regard to a cross-section of the bore hole for connecting a Kelly-bar.

5. The drilling bucket according to claim 1, wherein the upper guiding device has an arcuate outer surface for contacting the side wall of the bore hole.

6. The drilling bucket according to claim 1, wherein the hollow cylindrical body for containing cut soil material has a diameter and an axial height, wherein the diameter is greater than the axial height.

7. The drilling bucket according to claim 1, wherein a ratio of a diameter of the hollow cylindrical body to an axial height of the hollow cylindrical body is at least 1:1.

8. The drilling bucket according to claim 7, wherein the ratio of the diameter of the hollow cylindrical body to the axial height of the hollow cylindrical body is between 1:1 and 5:1.

9. The drilling bucket according to claim 1, wherein the upper guiding device is axially displaced from the hollow cylindrical body.

10. The drilling bucket according to claim 1, wherein the upper guiding device is detachably connected to the hollow cylindrical body.

11. The drilling bucket according to claim 1, wherein a plurality of cutting elements is disposed at the lower side of the hollow cylindrical body, wherein upon rotation of the drilling bucket soil material is removed along substantially the entire cross-section of the hollow cylindrical body.

12. The drilling bucket according to claim 1, wherein the lower guiding device includes a guide ring.

13. The drilling bucket according to claim 1, wherein the lower guiding device is configured to leave a substantially ring-shaped passageway around the hollow cylindrical body for a fluid bypass around the circumference of the hollow cylindrical body.

14. The drilling bucket according to claim 1, wherein the cutting tool extends in a radial direction beyond an outer periphery of the hollow cylindrical body.

15. The drilling bucket according to claim 1, wherein a soil conveying element is arranged below the hollow cylindrical body for conveying soil material radially inwardly into the hollow cylindrical body.

16. The drilling bucket according to claim 1, wherein a soil displacement element is provided for displacing soil material into the side wall of the bore hole.

17. A discontinuous drilling machine comprising a mast, a drill rod, a rotary drive for rotationally driving the drill rod, a drilling bucket including a hollow cylindrical body, at least one cutting tool arranged at a lower side of the hollow cylindrical body for cutting soil material, the hollow cylindrical body having a lower opening for receiving soil material cut by the at least one cutting tool, and an upper guiding device for guiding the hollow cylindrical body in the bore hole, the upper guiding device being arranged above the hollow cylindrical body and fixed to the hollow cylindrical body and being configured to abut on a side wall of the bore hole, a lower guiding device arranged around an outer circumference of the hollow cylindrical body for abutment against the side wall of the bore hole, and the upper and lower guiding devices each have a diameter which is larger than a diameter of the hollow cylindrical body, said drilling bucket being connected to a lower end of the drill rod, wherein the hollow cylindrical body for the discontinuous drilling machine is configured to be filled with soil material, lifted above the ground, evacuated and then again placed in the bore hole for further excavation of soil material, wherein at least one of the upper guiding device and the lower guiding device is ring-shaped, and wherein at least one of the upper guiding device and the lower guiding device comprises a continuous arcuate outer surface having a continuous diameter.

18. A method for discontinuously drilling a bore hole in the ground, said method comprising the steps of rotating a drilling bucket having a hollow cylindrical body and at least one cutting tool arranged at a lower side of the hollow cylindrical body, filling the hollow cylindrical body with soil material cut by the at least one cutting tool, abutting an upper guiding device arranged above the hollow cylindrical body on a side wall of the bore hole and guiding the hollow cylindrical body within the bore hole during drilling of the bore hole, and arranging a lower guiding device around an outer circumference of the hollow cylindrical body, wherein the upper and lower guiding devices each have a diameter which is larger than a diameter of the hollow cylindrical body, wherein the hollow cylindrical body for discontinuously drilling the bore hole in the ground is filled with soil material, lifted above the ground, evacuated and then again placed in the bore hole for further excavation of soil material, wherein at least one of the upper guiding device and the lower guiding device is ring-shaped, and wherein at least one of the upper guiding device and the lower guiding device comprises a continuous arcuate outer surface having a continuous diameter.

* * * * *